US006901611B2

(12) United States Patent
McEntire et al.

(10) Patent No.: US 6,901,611 B2
(45) Date of Patent: Jun. 7, 2005

(54) BATHTUB WASTEWATER HEAD FITTING

(75) Inventors: Allen McEntire, Goshen, IN (US); Maynard Searing, LaPorte, IN (US); Scott Searing, Kingsbury, IN (US); Fred Krolzick, South Bend, IN (US)

(73) Assignee: J&B Products, Inc., South Bend, IN (US)

( * ) Notice: Subject to any disclaimer, the term of this patent is extended or adjusted under 35 U.S.C. 154(b) by 0 days.

(21) Appl. No.: 10/630,952

(22) Filed: Jul. 30, 2003

(65) Prior Publication Data

US 2005/0022300 A1 Feb. 3, 2005

(51) Int. Cl.[7] ..... E03C 1/12
(52) U.S. Cl. ..... 4/680; 4/694; 138/90; 73/498
(58) Field of Search ..... 4/680–687, 694, 4/695; 137/797; 138/90; 73/49.1, 49.8

(56) References Cited

U.S. PATENT DOCUMENTS 6,192,531 B1 2/2001 Fritz et al.
6,289,532 B1 9/2001 Fritz et al.
6,295,664 B2 10/2001 Fritz et al.

*Primary Examiner*—Gregory L. Huson
*Assistant Examiner*—Peter deVore
(74) *Attorney, Agent, or Firm*—R. Tracy Crump

(57) ABSTRACT

A head fitting for a bathtub waste water drainage system is disclosed. The head fitting simplifies leak testing in bathtub waste water drainage system and eliminates the need for a separate test cap and fastening hardware for leak testing. The head fitting includes an internal partition wall and a breakout test plug molded as an integral part of the head fitting. The internal partition wall and breakout test plug initially hermetically seal the flow passage of the head fitting for leak testing the drainage system. The test plug can be broken out from the internal partition wall to open the flow passage after leak testing and without damaging the head fitting. The test plug forms part of the partition wall defined by an annular groove in the partition wall. The groove forms an annular band of relatively thin material (fracture band) that integrally connects the test plug to the partition wall, but allows the test plug to be forcefully separated from the partition wall.

5 Claims, 5 Drawing Sheets

BATHTUB WASTEWATER HEAD FITTING

This invention relates to a plumbing fitting used in a bathtub overflow drain, and in particular, a head fitting having an integral break away plug used to leak test the drainage system during installation in a bathtub.

BACKGROUND OF THE INVENTION

Conventional bathtubs include both bottom and overflow drains, which are connected to a wastewater drainage system. Special drain fittings have been developed specifically for bathtub wastewater drainage systems. The specialized elbow fittings connected to the bath overflow drains are commonly referred to as head fittings. The fittings connected to the bottom drains are commonly referred to as shoes. In a bathtub waste water drainage system, the head and shoe fittings are teed together and connected to the main wastewater drainage system.

Heretofore, conventional head and shoe fittings for bathtub wastewater systems have had several drawbacks. Certain building codes and conventional installation practices require that any waste water drainage system be fully sealed and leak tested before use. Leak testing a bathtub waste water drainage system involves closing the tub drains (sealing the flow passages) and applying a back pressure (air or water) within the drain line. Consequently, conventional head and shoe fittings must be accompanied by separate test caps or cover plates used solely for the purpose of leak testing the drainage system. These test caps and cover plates are mounted over the drains and secured directly to the fittings by screws, bolts and other fasteners. Typically, gaskets and rubber seals are applied to the test caps to ensure an air tight seal of the drain.

The need for separate test caps and cover plates adds both component and installation costs to the waste water drainage system and complicates the installation process. The test caps must be carefully mounted to the fittings to create an air tight seal, otherwise the leak test will be compromised. Once the leak tests are completed, the installer removes the test caps. Installing and removing test caps for solely leak testing adds to the installation time, thereby adding cost. Furthermore, test caps are typically discarded after the leak test and not reused on other installation jobs. For convenience, head and shoe fittings are sold as a kit with test caps and finish covers. Consequently, separate test caps for head and shoe fittings add to the total component cost of the bathtub wastewater system.

Ultimately, it would be advantageous to improve head and shoe fittings that simplify the leak testing process and reduce the number of components to provide general cost and time savings in bathtub waste water drainage system.

SUMMARY OF THE INVENTION

The bathtub wastewater head fitting of this invention simplifies leak testing in bathtub waste water drainage systems and eliminates the need for a separate test cap, fasteners and seals for leak testing. The head fitting includes an internal partition wall and a breakout test plug molded as an integral part of the head fitting. The internal partition wall and breakout test plug initially hermetically seal the flow passage of the head fitting for leak testing the drainage system. The test plug can be broken out from the internal partition wall to open the flow passage after leak testing and without damaging the head fitting. The test plug forms part of the partition wall defined by an annular groove in the partition wall. The groove forms an annular band of relatively thin material (fracture band) that integrally connects the test plug to partition wall, but allows the test plug to be forcefully separated from the partition wall.

The head fitting is mounted in a conventional manner to the overflow drain of a bathtub. Once the head fitting is connected, the bathtub waste water drainage system can be leak tested. The internal partition wall and test plug provide an initial barrier to completely close and seal the flow passage of the head fitting. Applying a back pressure within the drainage system allows an installer to physically examine the fitting connections for fluid leaks without installing a separate test cap to the head fitting. Once the leak test is complete, the installer simply breaks out the test plug to open the flow passage. The test plug is physically removed by grasping the tab by the hand or a pair of pliers and applying an up and down vertical force.

Accordingly, an advantage of this invention is that the head fitting speeds and simplifies installation and reduces installation costs.

Another advantage is that the head fitting eliminates the need for a separate test cap for leak testing of a bathtub waste water drainage system.

Another advantage is that the head fitting reduces the number of components carried by an installer for installing a bathtub waste water drainage system.

Another advantage of this invention is that the head fitting incorporates an integrated break away test plug, which provides a flow passage seal for leak testing, but can be readily removed after testing to open the flow passage.

Another advantage of this invention is that the break away test plug can be removed readily with a pair of pliers, which are commonly carried by installers.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to best explain the invention so that others skilled in the art might utilize its teachings.

Figure 1:
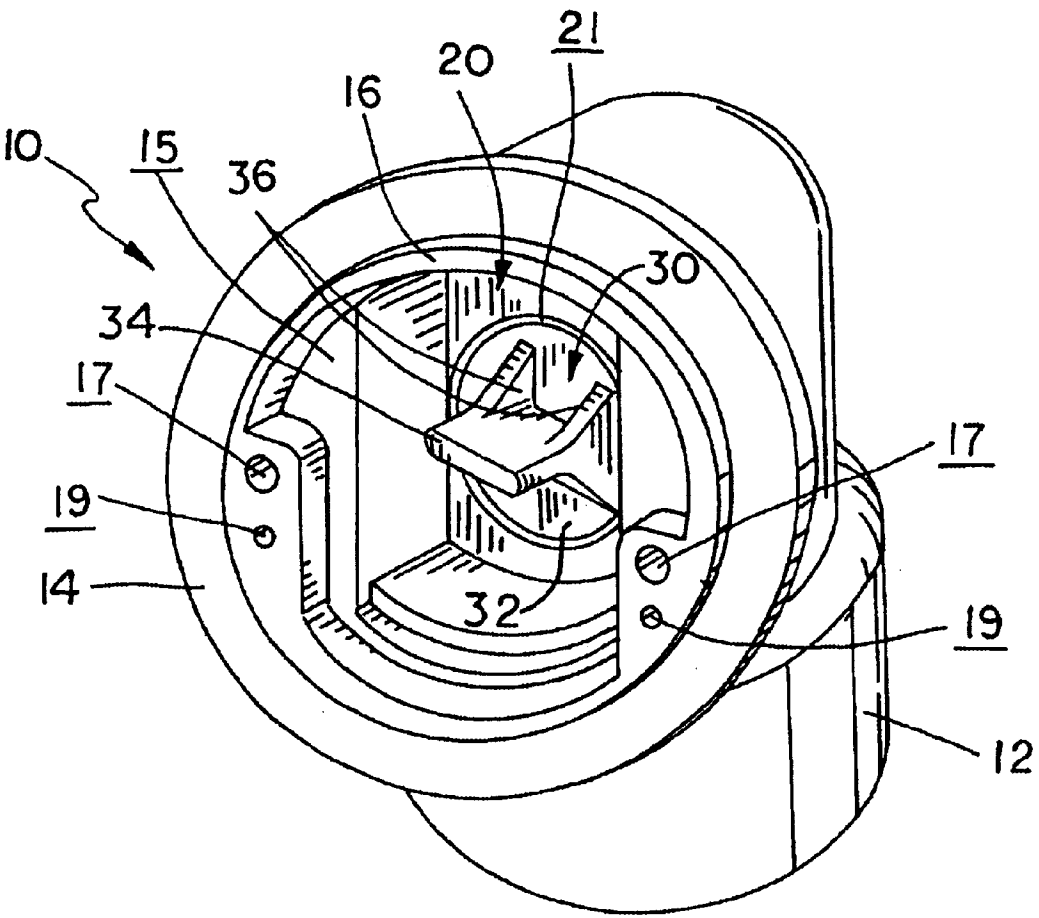
FIG. 1 is a perspective view of the head fitting of this invention.
Figure 2:
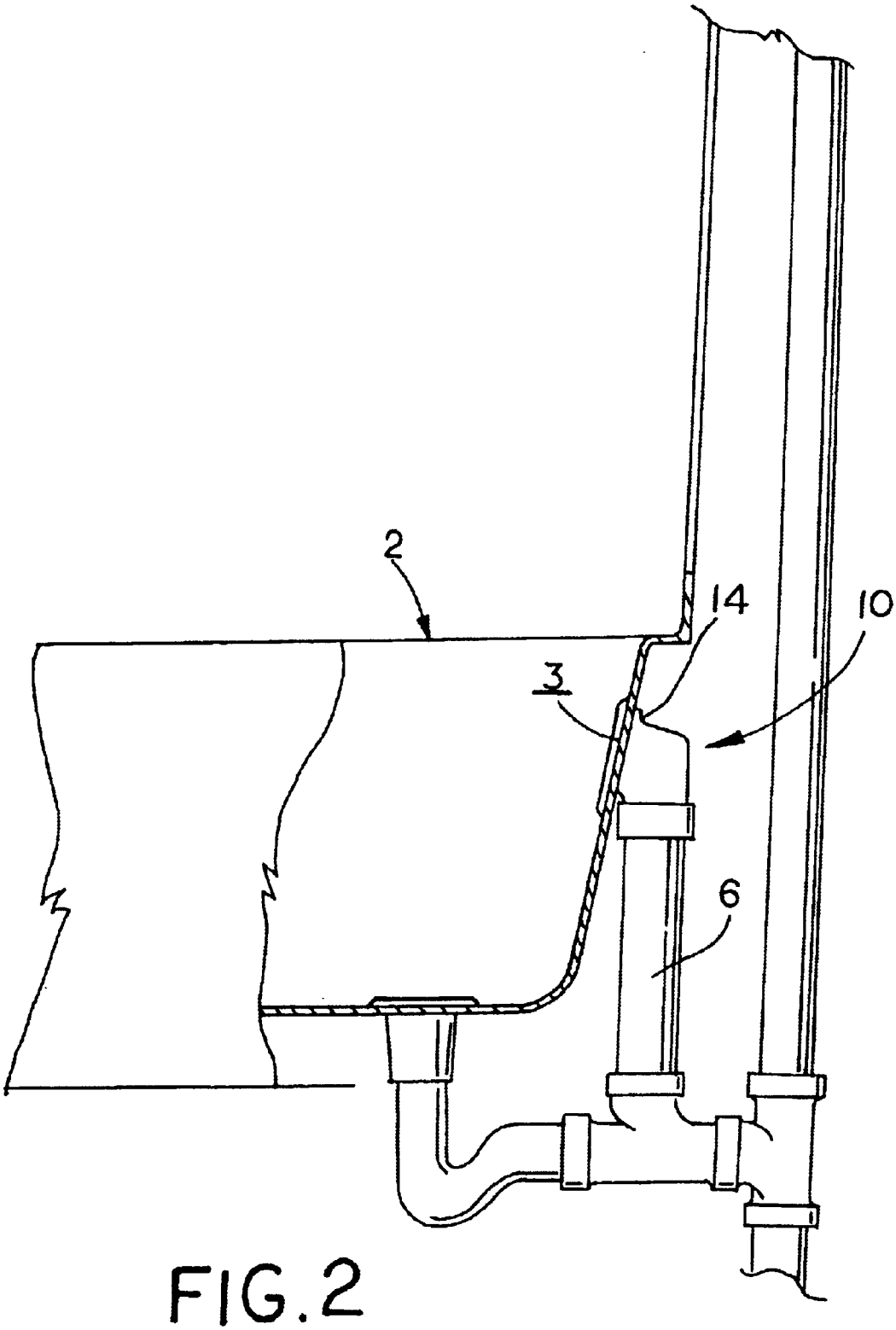
FIG. 2 is a side sectional view of the head fitting illustrated in a typical bathtub waste water drainage system.
Figure 3:
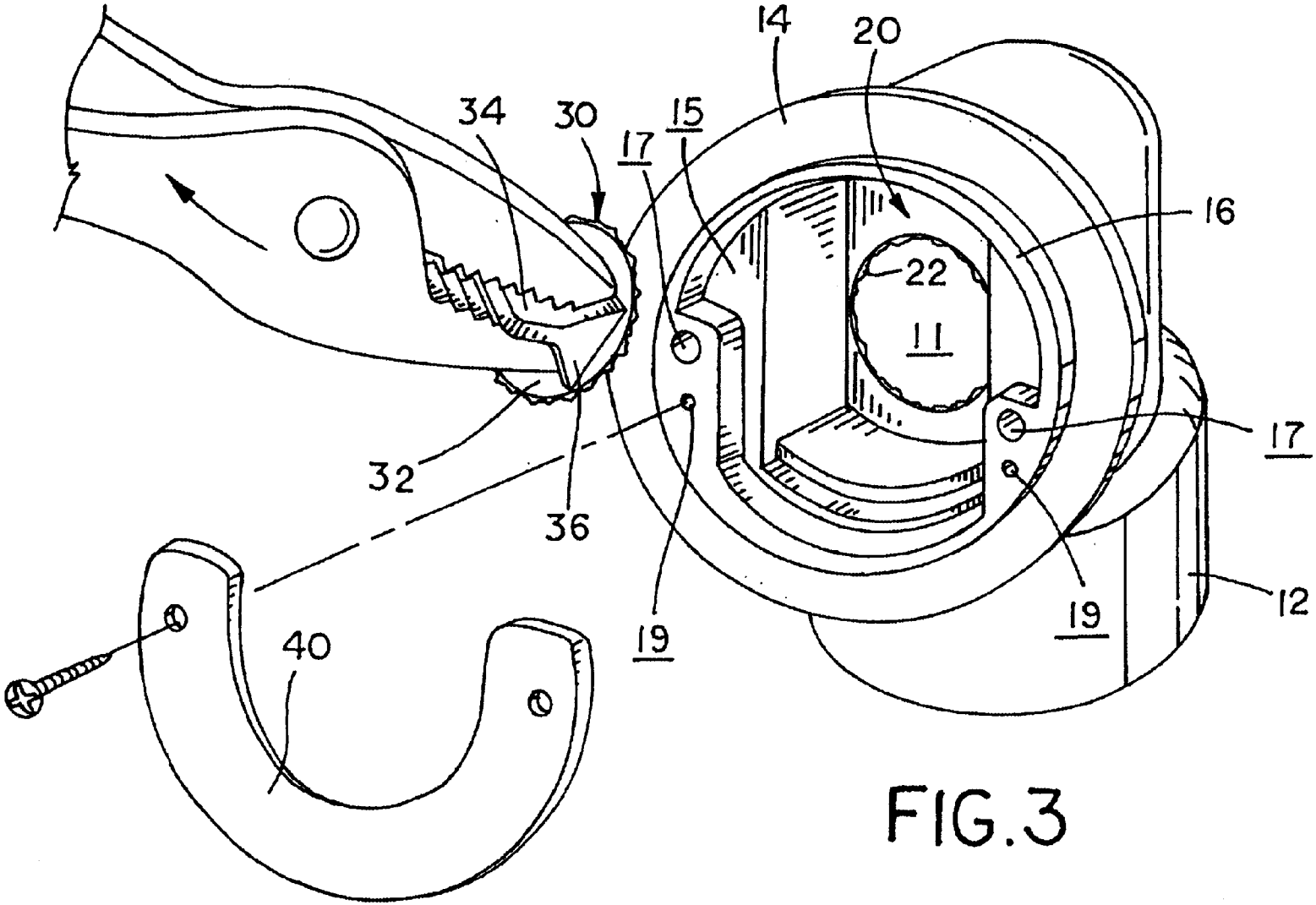
FIG. 3 is a perspective view of the head fitting of this invention showing the breakaway plug removed and a U-shaped support plate.

The figures show the head fitting of this invention designated generally as reference numeral 10. Head fitting 10 is configured and intended for use as an elbow joint connecting a bathtub overflow drain to a waste water drainage system, but may be adapted for use in other applications without deviating from the teachings herein. As shown in FIG. 1, head fitting 10 is constructed of any polymeric material such as, nylon, polyethylene, polypropylene, acrylonitrile butadiene styrene (ABS), vinyl polymers, and other polymer and copolymer plastics, and in particular polyvinyl chloride (PVC). These materials are commonly used in plumbing fittings and piping. The polymeric materials provide a material suitable for the structural integrity of the fitting while allowing the breakaway features of the integral internal plug. Head fitting 10 has a traditional elbow shaped body that defines a flow passage 11. Head fitting 10 terminates in a cylindrical collar 12 at one end and a flat annular flange 14 at the other end. Collar 12 provides a female coupling with an open throat 13 for receiving the end of a pipe of the tub drainage system. Flange 14 provides a coupling with an open mouth 15 for connections to the over flow drain opening of a bathtub. As shown, head fitting 10 is not a 90 degree elbow and the face of flange 14 is offset several degrees from normal with respect to the throat of collar 12. This offset angle generally corresponds to the slope of the inclined end walls of conventional bath tubs. Flange 14 includes an inset raised annular rim 16. The outer diameter of rim 16 is dimensioned to be inserted into the overflow opening of a bathtub and is used to squarely align and seat the head fitting against tub end wall 4. Rim 16 has a pair of bores 17, in which fasteners are turned to secure a finish cover plate (not shown) once the drainage system is properly installed. Rim 16 has a second set of bores 19, which are used to secure a temporary U-shaped support bracket 40 (FIG. 3). Support bracket 40 is used to brace head fitting 10 against the tub end wall while the leak test is performed and before the finish cover plate is secured to the head fitting.

Figure 4:
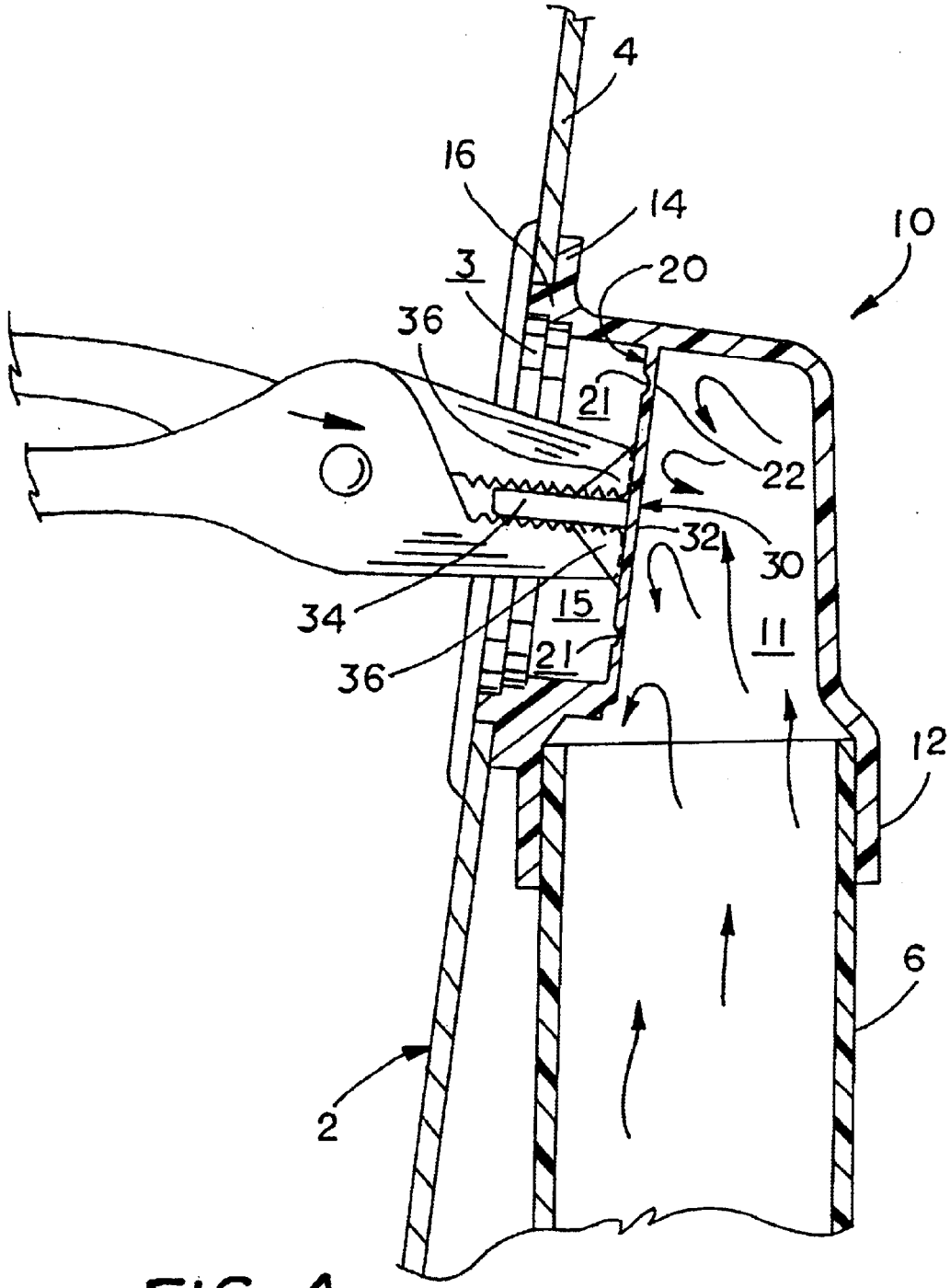
FIG. 4 is a side sectional view of the head fitting of this invention mounted to the end wall of a conventional bathtub over its overflow drain with the test plug blocking the flow passage.
Figure 5:
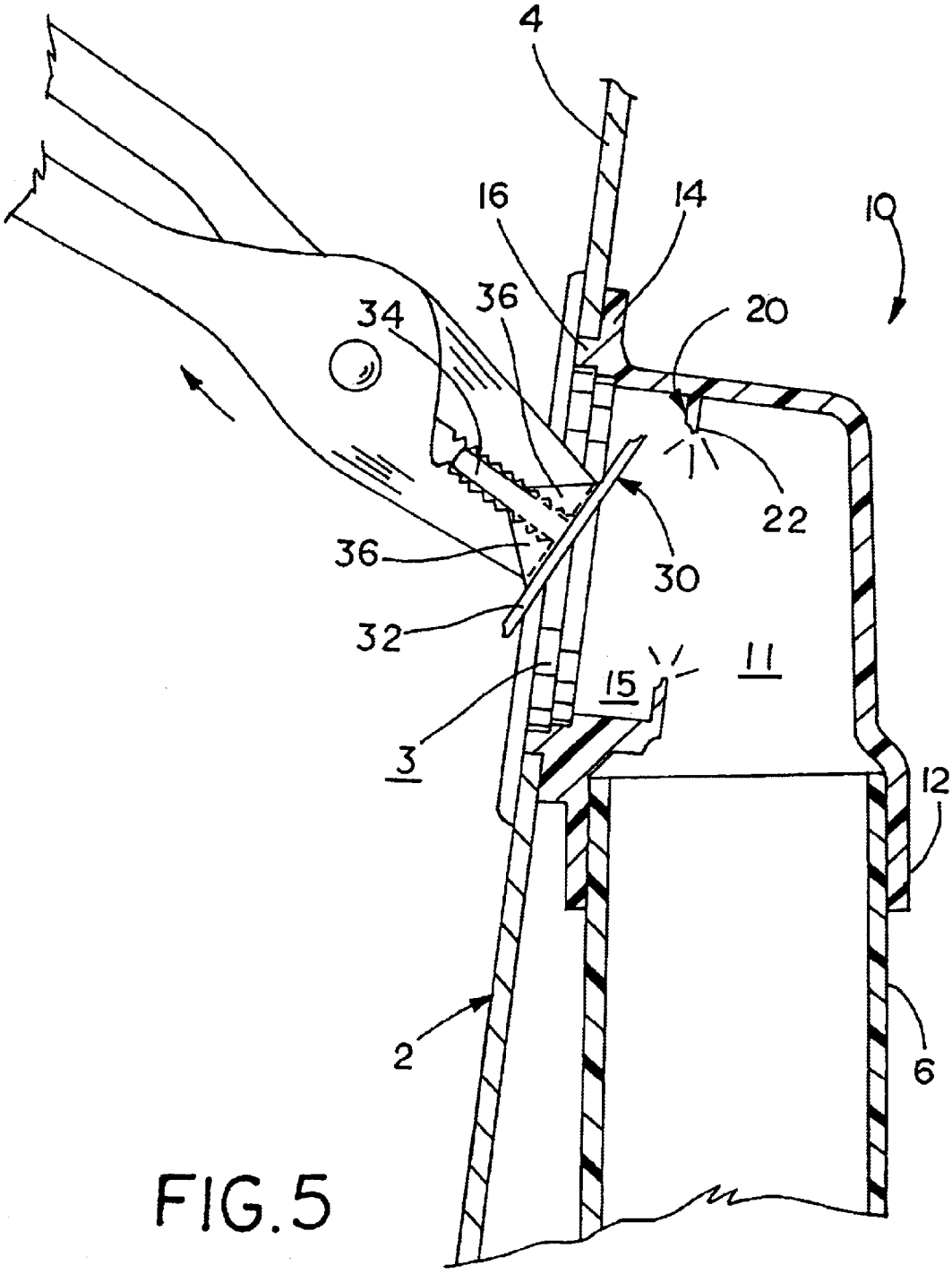
FIG. 5 is a side sectional view of the head fitting of this invention mounted to the end wall of a conventional bathtub over its overflow drain with the breakaway plug removed to open the flow passage.

As shown in FIGS. 1, 4 and 5, head fitting 10 also includes an internal partition wall 20 and breakout test plug 30. Partition wall 20 and test plug 30 are molded as an integral part of head fitting 10, and are inset from the open mouth of flange 14 so that test plug 30 is physically accessible there through. As shown, partition wall 20 and test plug 30 provide an initial sealed barrier, which closes flow passage 11 of head fitting 10. After leak testing, test plug 30 can be easily broken out from partition wall 20 to open flow passage 11. Test plug 30 includes a flat circular plate 32 which forms part of partition wall 20 and is defined by an annular groove 21 in partition wall 20. Groove 21 forms a thin band of material (fracture band 22) that integrally connects test plug 30 to partition wall 20. Generally, partition wall 20 has a thickness of approximately 0.080 inches and plug plate 32 has a thickness of approximately 0.120 inches. Groove 21 has a bevel surface and fracture band 22 has a thickness of approximately 0.030 inches. The relatively thin material of fracture band 22 allows test plug 30 to be forcefully separated from partition wall 20 along groove 21. Plug plate 32 has a diameter of approximately 1.20 inches, which is large enough to allow water drainage through head fitting 10 in most bathtub applications. Test plug 20 also includes a tab 34 which extends from plug plate 32 and through flange mouth 15. Tab 34 provides a lever for forceably breaking out test plug 30 from partition wall 20. A pair of opposed gussets 36 support tab 34 on either side. Tab 34 and gussets 36 are dimensioned so that the head of pair of pliers can grip the tab between the gussets. Tab 34 is oriented horizontally so that torque will be applied to test plug 30 vertically. Gussets 36 provide rigidity to both tab 34 and plug plate 32, which helps to ensure that it will break out easily along groove 21.

FIGS. 2–5, illustrate head fitting 10 mounted to a conventional bathtub (designated as reference numeral 2) in a typical waste water drainage system. Bathtub 2 includes an end wall 4 extending downward and inclined at an angle alpha as shown. A circular overflow opening 3 is form in end wall 4. The drainage system includes piping that tees together the over flow and bottom drains of bathtub 2. As shown, head fitting 10 is connected to overflow drain 3 and straight drain pipe 6. Normally, water in tub 2 will not rise to the level of overflow opening 3, but if it does, it flow through head fitting 10 into the drainage system. As shown, flange 14 abuts against the outer surface of tub end wall 4. The face of flange 14 is angled to abut parallel to tub end wall 4. Normally, support bracket 40 (shown in FIGS. 3–5) braces and reinforces the connection between the tub and head fitting during leak testing, but allows access to the test plug. Ideally, a gasket or sealing compound (not shown) is applied to the head fitting between the flange and tub end wall to seal the connection and prevent leaks between the head fitting and tub. Once head fitting 10 is connected to tub 2 and the drainage system, the leak test can be conducted. With test plug 30 initially obstructing flow passage 11, back pressure is applied in the drainage system and installers physically examine the fittings for fluid leaks. Once the leak test is complete, the installer breaks out test plug 30. The installer grasps tab 34 using a pair of pliers and applies an up and down vertically to break out test plug 30 from partition wall 20. With test plug 30 removed, the installer removes support bracket 40 and mounts the finish cover plate (not shown) to the head fitting to complete installation.

Advantages

One skilled in the art will note several advantages to the head fitting of this invention. In a bathtub waste water drainage system, the head fitting of this invention speeds and simplifies installation and reduces installations costs. The installation and component costs of the head fitting are also reduced by eliminating the need for separate test caps and plates, which are typically discarded after the leak test is completed. The head fitting includes an internal partition wall and a breakout test plug molded as an integral part of the head fitting. The internal partition wall and breakout test plug initially hermetically seal the flow passage of the head fitting for leak testing the drainage system. The test plug can be broken out from the internal partition wall to open the flow passage after leak testing and without damaging the head fitting. The test plug can readily withstand the back pressure experienced during leak testing, without the use of additional seals or gaskets. Consequently, the head fitting eliminate the seals and gaskets needed for the separate test caps of conventional head fittings.

Integrating a breakout test plug into the head fitting reduces installation time, tools, and hardware. Installers do not have to handle, install and remove separate test caps solely for performing a leak test of the waste water system. Installers do not need a separate test cover, nor any additional hardware or fasteners. The plugs can be removed readily with a pair of pliers, which are commonly carried by installers. No additional seals, fasteners or other hardware is needed to perform the leak test or complete the installation.

It is understood that the above description does not limit the invention to the details given, but may be modified within the scope of the following claims.

What is claimed is:

1. A head fitting adapted for connection to a bathtub having an overflow opening in a waste water drainage system, the head fitting comprising:

a molded elbow-shaped body constructed of a polymeric material and defining an interior flow passage therethrough, the body having an annular flange at one end thereof defining an open mouth for sealed engagement against the side wall of a bathtub over the overflow opening of the bathtub, a cylindrical collar at the other end defining an open throat for connecting the body to the waste water drainage system, and a selectively removable test plug integrally molded within the flow passage and inset from the open mouth of the flange so as to completely seal and close the flow passage between the open mouth of the flange and the open throat of the collar, the test plug being formed as an integral part of the body that can be physically broken away from the body and removed to open the flow passage so that the test plug constitutes means for leak testing the drainage system when the plug is integrally disposed within the flow passage of the body.

2. The head fitting of claim 1 wherein the test plug is accessible through the open mouth of the flange.

3. The head fitting of claim 1 wherein the test plug including a flat plate and a thin peripheral band integrally connecting the plate to the body, whereby the thin peripheral band facilitates the breaking of the plug from the body to opening the flow passage between the flange mouth and the collar opening.

4. The head fitting of claim 3 wherein the test plug also includes a flat tab protruding from the wall and extending through the flange mouth.

5. The head fitting of claim 4 wherein the mouth of the flange lies within a first plane and the open throat of the collar lies in a second plane, the tab aligns perpendicular to the first and second planes.

* * * * *